US006199414B1

(12) United States Patent
Chang

(10) Patent No.: US 6,199,414 B1
(45) Date of Patent: Mar. 13, 2001

(54) QUICK RELEASE LOCKING MEANS FOR A COVER

(76) Inventor: Ming-Huang Chang, No. 25, Tzu Chiang Rd., Chi Tu Dist., Keelung City (TW)

( * ) Notice: Subject to any disclaimer, the term of this patent is extended or adjusted under 35 U.S.C. 154(b) by 0 days.

(21) Appl. No.: 09/487,278

(22) Filed: Jan. 19, 2000

(51) Int. Cl.[7] ..... B65D 55/14

(52) U.S. Cl. ..... 70/168; 70/169; 70/DIG. 34; 292/11; 292/30; 292/49; 292/53; 292/55; 292/124; 292/224

(58) Field of Search ..... 70/121, DIG. 34, 70/158–163, 165–173; 292/11, 30, 49, 53, 55, 124, 127, 224, 227, DIG. 11

(56) References Cited

U.S. PATENT DOCUMENTS

| | | | | |
|---|---|---|---|---|
| 289,666 | * | 12/1883 | Lee | 292/127 |
| 317,153 | * | 5/1885 | Lowrie . | |
| 969,776 | * | 9/1910 | Foley . | |
| 1,055,797 | * | 3/1913 | Redding | 70/169 |
| 1,083,378 | * | 1/1914 | Smith | 70/169 |
| 1,473,986 | * | 11/1923 | Brown | 70/169 |
| 1,548,767 | * | 8/1925 | Steele | 70/168 |
| 1,553,639 | * | 9/1925 | Sherman | 70/167 |
| 1,805,789 | * | 5/1931 | Stuart et al. | 292/127 |
| 2,014,112 | * | 9/1935 | McCord | 292/142 X |
| 2,050,362 | * | 8/1936 | Mims | 292/127 X |
| 2,501,722 | * | 3/1950 | Hammerly et al. | 292/256.73 |
| 4,844,518 | * | 7/1989 | Pritchard | 292/28 |

FOREIGN PATENT DOCUMENTS

| | | | | |
|---|---|---|---|---|
| 607871 | * | 11/1960 | (CA) | 292/127 |
| 522239 | * | 4/1931 | (DE) | 292/224 |
| 207470 | * | 11/1923 | (GB) | 292/224 |
| 571326 | * | 8/1945 | (GB) | 292/227 |
| 453771 | * | 12/1949 | (IT) | 292/124 |

* cited by examiner

*Primary Examiner*—Lloyd A. Gall
(74) *Attorney, Agent, or Firm*—Rosenberg, Klein & Lee

(57) ABSTRACT

A quick release lock for a cover is provided. The cover may be a manhole cover for closing onto a manhole ring having a radially extended flange. The quick release lock mainly includes several angularly equal-spaced cross-shaped slots provided on the cover to communicate with through holes below them, and catch elements, push elements, and cotters in the same number as that of the cross-shaped slots. The catch element each is pivotally connected to and between two fixing plates provided at two opposite sides of each through hole. The cotter each is positioned in one cross-shaped slot and extended down into she through hole. The push element each is screwed on a bar portion of the cotter below the cover. When the cotter is depressed, the push element radially pushes the catch element outward to engage with a lower edge of the flange on the ring member and thereby firmly locks the cover to the ring member. And, when the cotter is pulled upward, the push element no longer pushes the catch element so that the latter disengages from the ring member and allows the cover to be easily removed from the ring member.

5 Claims, 5 Drawing Sheets

QUICK RELEASE LOCKING MEANS FOR A COVER

BACKGROUND OF THE INVENTION

The present invention relates to a quick release locking means for a cover, and more particularly to a quick release locking means that allows, for example, a manhole cover to be easily closed onto and released from a manhole ring simply by pushing and pulling some cotters.

As known by everyone, the manhole cover is a thick and heavy member made of metal. The purpose to make the manhole cover so heavy is to ensure tight and firm location of the manhole cover in the manhole ring, so that the manhole cover would not bounce open due to any vibration force transmitted to the manhole cover. However, since a conventional manhole cover does not have any locking means provided therewith for locking it to the manhole ring, it tends to bounce and produce noise whenever a vehicle contacts it. On the other hand, the manhole cover is so heavy that it would need a lot of time and labor to manually remove it from the manhole ring when necessary, such as at the time of maintaining or repairing underground conduit pipes.

SUMMARY OF THE INVENTION

It is therefore a primary object of the present invention to provide a quick release locking means for a cover, particularly a heavy manhole cover, so that the cover could be easily closed onto and released from a manhole ring simply by pushing and pulling some cotters.

To achieve this object, the quick release locking means of the present invention mainly includes several angularly equal-spaced cross-shaped slots provided on the cover to communicate with through holes below them, and catch elements, push elements, and cotters in the same number as that of the cross-shaped slots. The catch element each is pivotally connected to and between two fixing plates provided at two opposite sides of each through hole. The cotter each is positioned in one cross-shaped slot and extended down into the through hole. The push element each is screwed on a bar portion of the cotter below the cover. When the cotter is depressed, the push element radially pushes the catch element outward to engage with a lower edge of a flange on a manhole ring and thereby firmly locks the cover to the ring. And, when the cotter is pulled upward, the push element no longer pushes the catch element so that the latter disengages from the ring and allows the cover to be easily removed from the ring.

The cotter each has a washer put around its bar portion between the cross-shaped slot and the through hole on the cover, so that water is prevented from entering into the through hole via the cross-shaped slot.

The push element each is screwed onto the bar portion of the cotter and is therefore adjustable in its position relative to the cotter by turning the cotter. When the cotter is turned, the push element could be adjusted to a position for accurately pushing the catch element outward to firmly engage with the lower edge of the flange of the manhole ring.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
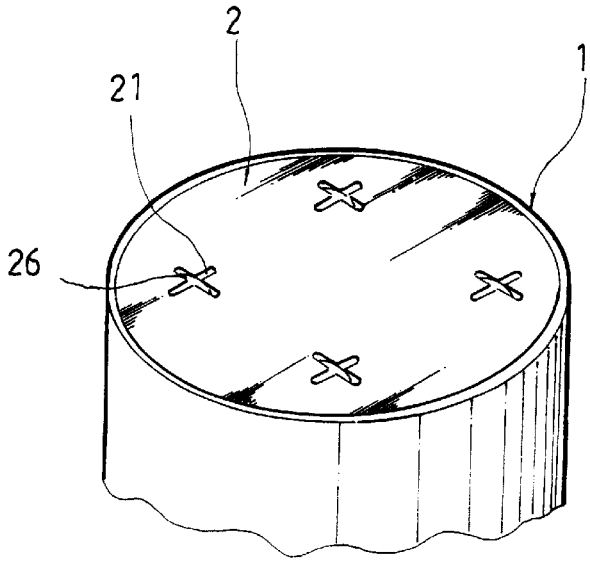
FIG. 1 is a fragmentary perspective of manhole ring and cover, wherein the manhole cover is provided with the quick release locking means according to the present invention.
Figure 2:
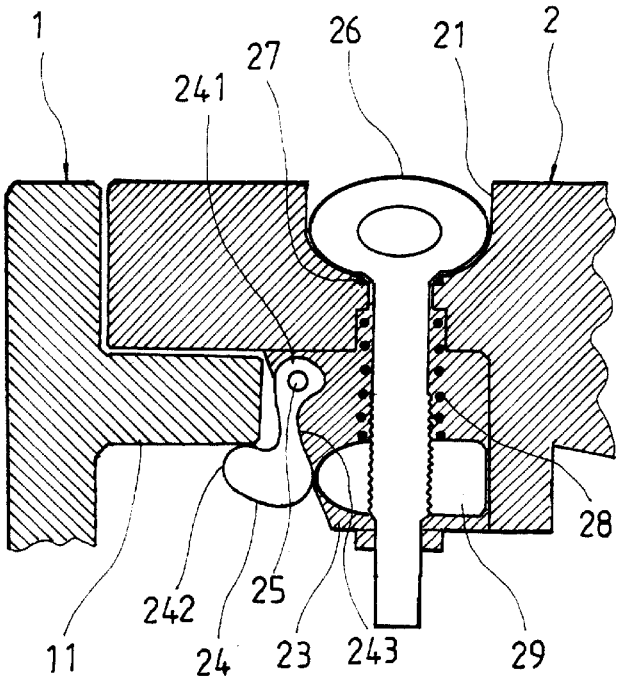
FIG. 2 is a fragmentary sectional view of the manhole ring and cover of FIG. 1.
Figure 3:
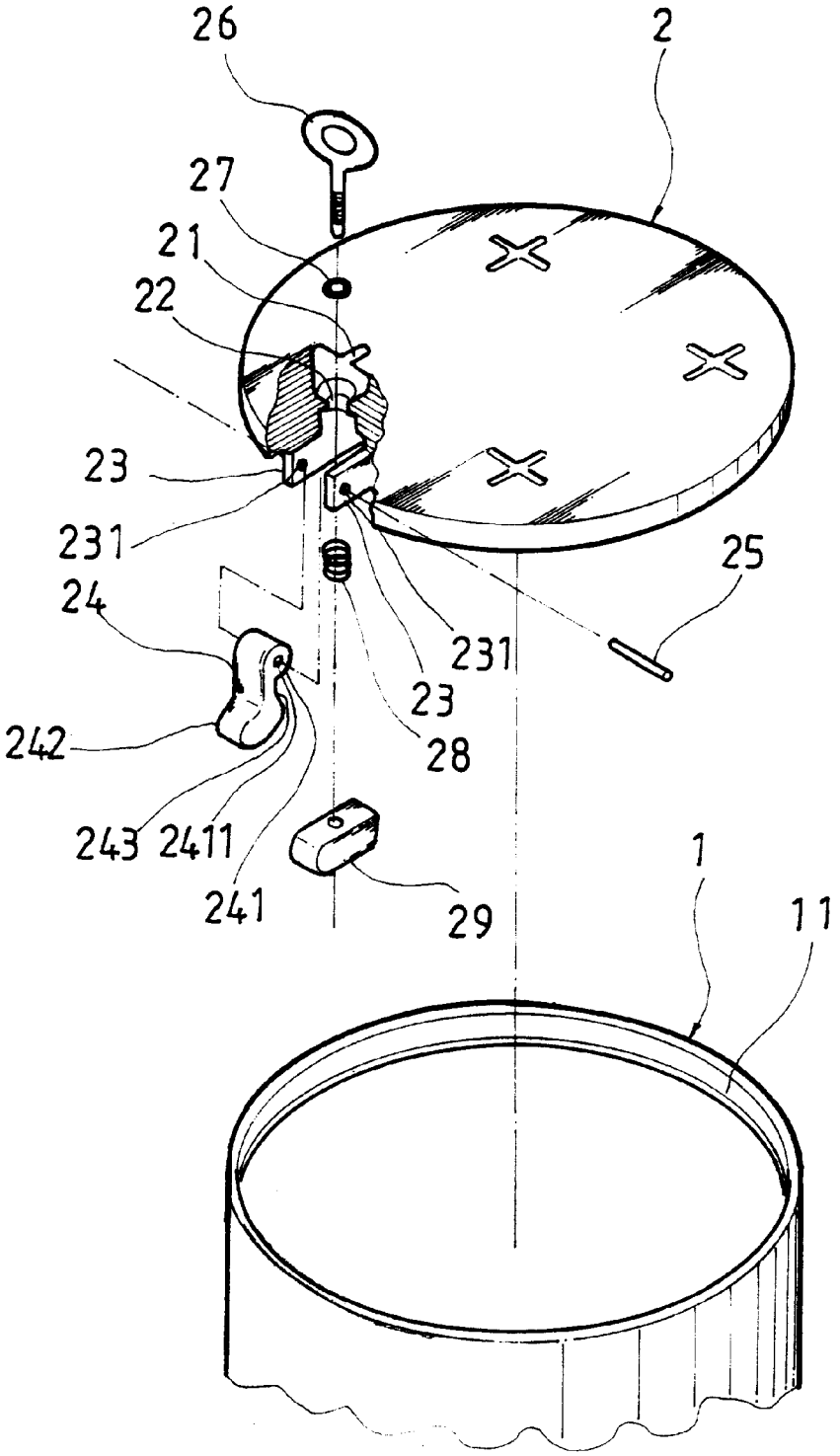
FIG. 3 is an exploded perspective of the manhole ring and cover of FIG. 1 with a part of the cover cut away to show internal structure thereof.

Please refer to FIGS. 1, 2 and 3 that are sequentially assembled perspective view, fragmentary sectional view, and exploded perspective view of a set of manhole ring 1 and cover 2 provided with a quick release locking means according to the present invention.

The manhole ring 1 is provided at an inner periphery near an upper end with a radially and horizontally inward extended flange 11.

The manhole cover 2 is provided with several angularly equal-spaced cross-shaped slots 21. In this case, four cross-shaped slots 21 are shown in FIG. 1. Below each of the cross-shaped slots 21, there is a through hole 22. Two symmetrical fixing plates 23 are oppositely provided at lower end of each through hole 22 with one end radially pointing outward. A pin hole 231 is provided on each of the-fixing plates 23 near the radially outer end thereof for a pin 25 to extend therethrough. A catch element 24 is pivotally connected to the pin 25 to locate between the two fixing plates 23. The catch element 24 has a generally S-shaped configuration to include a curved top portion 241 projected toward the through hole 22 and a curved lower portion 242 projected toward the flange 11 of the manhole ring 1. A portion of the catch element 24 between the curved top portion 241 and the curved lower portion 242 and facing toward the manhole cover 2 is an inward curved surface 243. By extending the pin 25 through a fixing hole 2411 provided on the curved top portion 241 of the catch element 24, the catch element 24 is pivotally connected between the two fixing plates 23.

A cotter 26 is used to control locking and releasing of the catch element 24 to and from the flange 11 of the manhole ring 1. The cotter 26 includes a top portion that is a flat ring and a lower portion that is a long bar integrally extended from the flat ring. The cotter 26 is positioned in one of the cross-shaped slots 21 with a washer 27 disposed around the lower bar portion. The lower bar portion of the cotter 26 extends into the through hole 22 with a spring 28 put around it and a push element 29 perpendicularly screwed to an end thereof. Since the push element 29 is screwed onto the bar portion of the cotter 26, it is adjustable in position relative to the cotter 26 by turning the cotter 26. When the cotter 26 is turned, the push element 29 could be adjusted to a position for most accurately pushing the catch element 24 outward to firmly engage with the lower edge of the flange 11 of the manhole ring 1. In a first embodiment of the present invention, the push element 29 is a bar having a curved end facing toward the catch element 24 to facilitate smooth moving of the push element 29 while pressing against the catch element 24.

Figure 4:
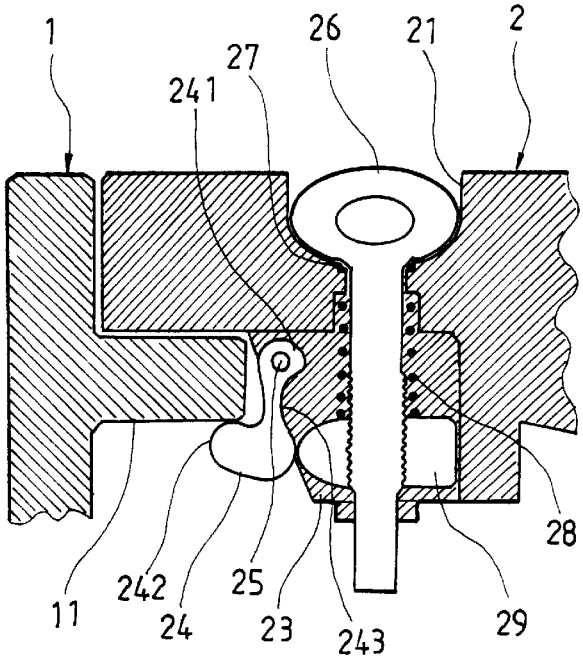
FIG. 4 is a fragmentary sectional view showing the quick release locking means provided on the manhole cover is in a locked state to lock the manhole cover to the ring.
Figure 5:
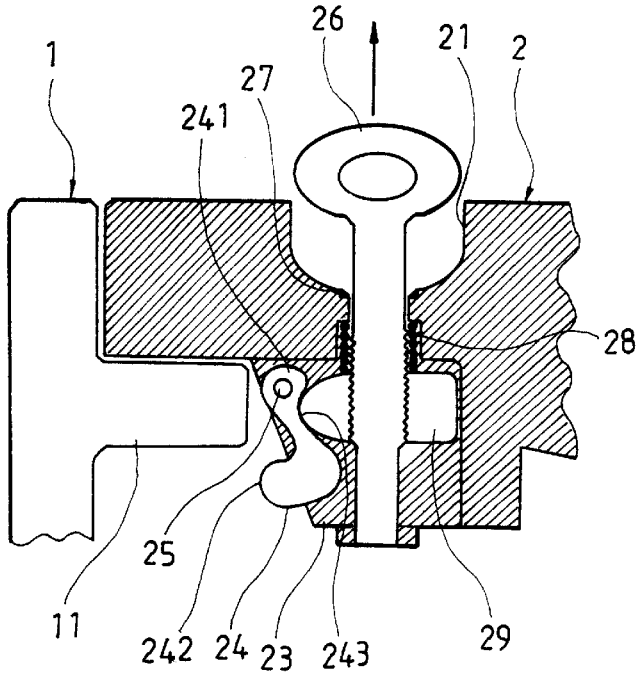
FIG. 5 is a fragmentary sectional view showing the quick release locking means is in a released state to release the manhole cover from the ring.

When the cover 2 is covered onto the manhole ring 1, the cotters 26 are depressed into the cross-shaped slots 21 and the through holes 22 one by one, so that the curved end of each push element 29 moves downward along and in contact with the curved surface 243 of the catch element 24 and finally pushes the curved Lower portion 242 of the catch element 24 radially outward to contact with and firmly retained by a lower edge of the flange 11 of the manhole ring 1, as shown in FIG. 4. When all the catch elements 24 provided below the manhole cover 2 have been pushed by the cotters 26 to engage with the lower edge of the flange 11, the cover 2 is tightly closed to the ring 1 without the risk of shifting or bouncing relative to the ring 1. And, when the cotter 26 is pulled upward relative to the manhole cover 2, the curved end of the push element 29 moves upward along the curved surface 243 and pushes against the curved top portion 241 of the catch element 24 to cause the curved lower portion 242 of the catch element 24 to disengage from the lower edge of the flange 11, as shown in FIG. 5. When all the cotters 26 are pulled upward to disengage all the catch elements 24 from the flange 11, the manhole cover 2 can be easily removed from the manhole ring 1.

Please refer to FIG. 4. When the manhole cover 2 is closed onto the manhole ring 1 with the cotters 26 in the depressed position to cause the catch elements 24 to engage with the lower edge of the flange 11 of the manhole ring 1, a tension of the springs 28 pushes the push elements 29 downward for the curved ends of the push elements 29 to always press against the curved surfaces 243 of the catch elements 24, keeping the curved lower portions 242 projected toward and located below the lower edge of the flange 11 of the manhole ring 1. The manhole cover 2 in this position is firmly and tightly pulled downward toward the ring 1 by the springs 28 and the catch elements 24 and would not undesirably vibrate or bounce in the manhole ring 1. The washer 27 disposed around the bar portion of each cotter 26 acts as a watertight member to prevent water from entering into the through hole 22 via the cross-shaped slot 21 and the cotter 26.

Please refer to FIG. 5. To open the manhole by removing the cover 2 from the ring 1, simply pull the cotters 26 upward one by one. At this point, the curved end of each push element 29 on the cotter 26 is brought to move upward from a lower end of the catch element 24 and pass the curved surface 243 to press against the curved top portion 241. Since the curved lower portion 242 of the catch element 24 is no longer radially pushed outward by the push element 29, it disengages from the lower edge of the flange 11. When all the catch elements 24 disengage from the flange 11, the cover 2 can be easily pulled upward to remove from the ring 1.

Figure 6A:
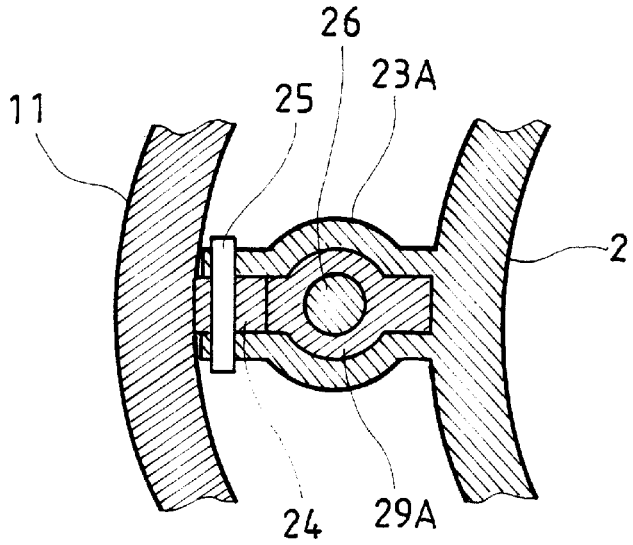
FIGS. 6A and 6B are fragmentary sectional views showing another two embodiments of the quick release locking means of the present invention.
Figure 6B:
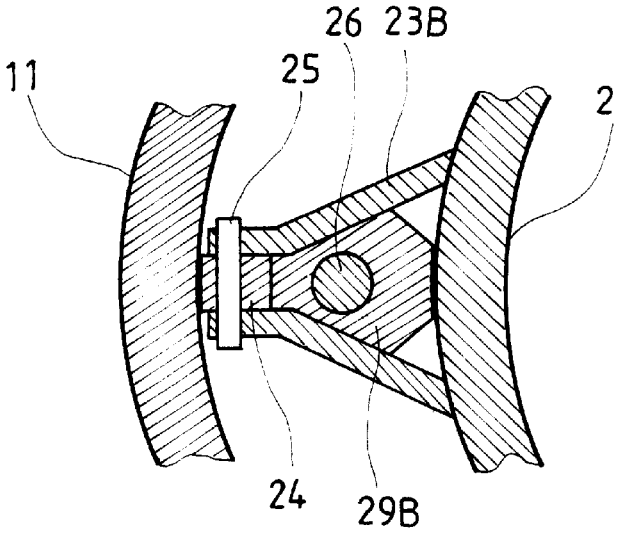

The push element 29 may be differently shaped, such as a push element 29A having a round middle portion as shown in FIG. 6A, or a push element 29B having an angular configuration as shown in FIG. 6B. To match with the push element 29A and 29B, fixing plates 23A and 23B having shapes corresponding to the configurations of the push elements 29A and 29B, respectively, are provided to achieve the same purpose of locking and releasing the catch element 24 to and from the flange 11.

Figure 7:
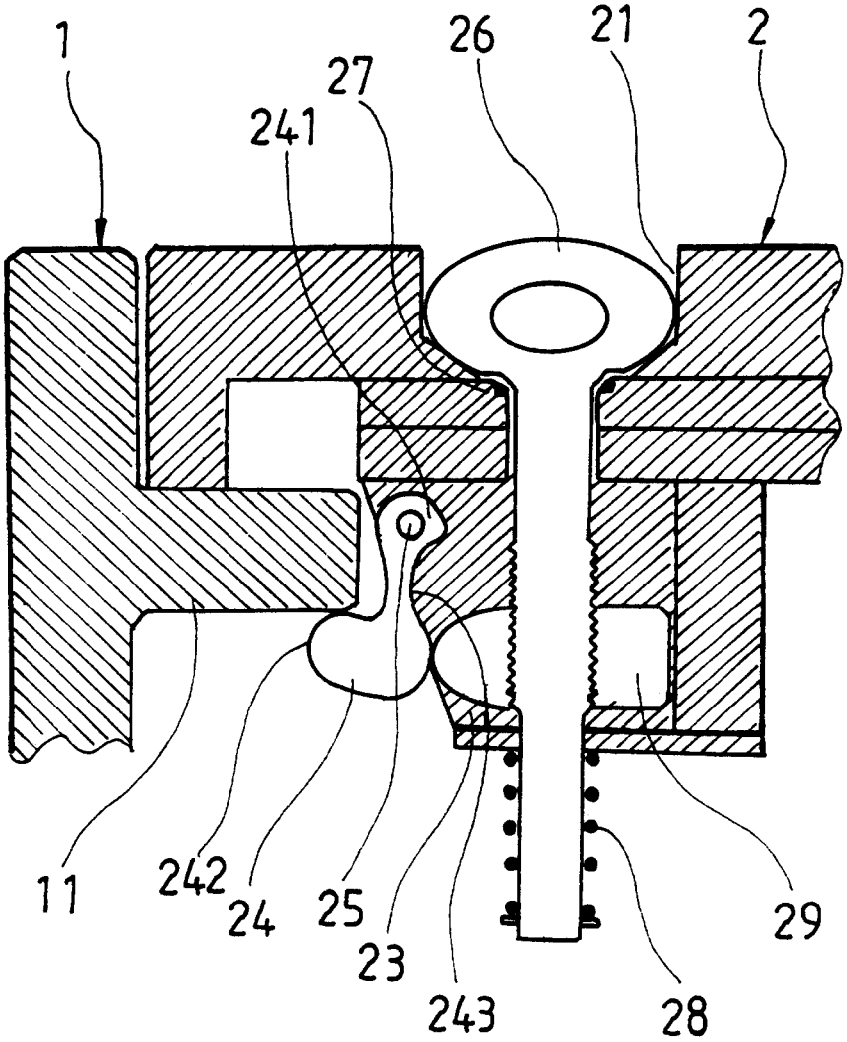
FIG. 7 is a fragmentary sectional view showing a further embodiment of the quick release locking means of the present invention.

FIG. 7 shows another embodiment of the present invention. In this embodiment, the spring 28 is disposed around the bar portion of each cotter 26 between a lower end of the cotter 26 and a bottom surface of the cover 2. When the cotter 26 is in a depressed position, a tension of the spring 28 always pulls the cotter 26 downward and therefore causes the push element 29 to always radially push the lower portion of the catch element 24 outward to engage with the lower edge of the flange 11, keeping the cover 2 tightly closed on the ring 1. On the other hand, when the cotter 26 is pulled upward, the push element 29 moves upward and no longer pushes the lower portion 242 of the catch element 24 outward, allowing the catch element 24 to disengage from the lower edge of the flange 11 for the cover 2 to be easily lifted from the ring 1 to open the manhole.

In brief, the present invention provides catch elements and push elements at a bottom of a manhole cover or the like, so that these elements may be controlled through cotters downward extended through the manhole cover to either quick lock or release the manhole cover to or from the manhole ring easily.

What is claimed is:

1. A quick release locking means and cover, said cover being adapated to be closed onto a ring member that is connected to an opening, such as a manhole, and has a horizontally and radially inward extended flange, said quick release locking means comprising angularly equal-spaced cross-shaped slots provided on said cover, and catch elements, push elements, and cotters in the same number as that of said cross-shaped slots;

said cross-shaped slots each communicating with a through hole below said slot, and two holed fixing plates being symmetrically and oppositely provided below each said through hole;

said catch elements each including a curved top portion projected toward said through hole, a curved lower portion projectable toward said flange of said ring member, and an inward curved surface between said curved top portion and said curved lower portion and facing toward said cover; and said catch elements each being pivotally connected to and between said two fixing plates provided below each said through hole by a pin extended through fixing holes provided on said curved top portion of said catch element and said fixing plates;

said cotters each including a flat ring portion forming a top thereof and a long bar portion forming a lower body thereof, each said cotter being positioned in one of said cross-shaped slots with said flat ring portion projected from said slot and said long bar portion extended down into said through hole, and a spring being disposed around said long bar portion in said through hole; and said push elements each being perpendicularly screwed onto said long bar portion of said cotter and having a curved end pointing toward said catch element;

whereby when each said cotter is depressed, said push element screwed thereto is moved to a position to radially push said curved lower portion of said catch element outward to engage with a lower edge of said flange on said ring member, bringing said cover to tightly lock to said ring member; and when each said cotter is pulled upward, said push element screwed thereto no longer pushes said curved lower portion of said catch element and allows said catch element to disengage from said flange on said ring member, allowing said cover to be easily lifted and removed from said ring member.

2. A quick release locking means and cover as claimed in claim 1, wherein said cotter each as a washer put around said bar portion between said cross-shaped slot and said through hole on said cover, so that water is prevented from entering into said through hole via said cross-shaped slot.

3. A quick release locking means and cover as claimed in claim 1, wherein said push elements are in the form of a rectangular block having a curved end, and said fixing plates being two straight plates for fitly contacting with two sides of said push element.

4. A quick release locking means and cover as claimed in claim 1, wherein said push elements are in the form of a round member, and said fixing plates being two curved plates for fitly contacting with two sides of said push element.

5. A quick release locking means and cover as claimed in claim 1, wherein said push elements are in the form an angular member having a curved end, and said fixing plates being two bent plates for fitly contacting with two sides of said push element.

* * * * *